United States Patent [19]

Manschwetus

[11] Patent Number: 4,917,314

[45] Date of Patent: Apr. 17, 1990

[54] ROTOR FOR A HAMMER MILL

[75] Inventor: Helmut Manschwetus, Fuldabrük, Fed. Rep. of Germany

[73] Assignee: Thyssen Industrie AG, Essen, Fed. Rep. of Germany

[21] Appl. No.: 173,443

[22] Filed: Mar. 25, 1988

[30] Foreign Application Priority Data

Mar. 25, 1987 [DE] Fed. Rep. of Germany ..... 3709800

[51] Int. Cl.[4] ..... B02C 13/04

[52] U.S. Cl. ..... 241/194

[58] Field of Search ..... 241/189 R, 194, 197, 241/195, 300

[56] References Cited

U.S. PATENT DOCUMENTS

| | | | |
|---|---|---|---|
| 1,728,392 | 9/1929 | Clement | 241/194 |
| 3,727,848 | 4/1973 | Francis | 241/194 |
| 4,056,232 | 11/1977 | Linnerz et al. | 241/194 |
| 4,313,575 | 2/1982 | Stepanek | 241/197 X |
| 4,403,743 | 9/1983 | Ducasse | 241/194 |
| 4,613,088 | 9/1986 | Hausler et al. | 241/197 |
| 4,650,129 | 3/1987 | Newell et al. | 241/197 X |

*Primary Examiner*—Mark Rosenbaum
*Attorney, Agent, or Firm*—Robert W. Becker

[57] ABSTRACT

A rotor for a hammer mill. A plurality of support elements rest against one another in the axial direction and are staggered in a circumferential direction. Hammers are pivotably mounted on hammer shafts that are disposed in ends of the support elements. The hammers are disposed between two axially adjacent support element ends. Caps are provided on the support element ends, with both the caps that immediately follow one another in the circumferential direction, as well as the hammers that immediately follow one another in the circumferential direction, being staggered in the direction of the axis of rotation of the rotor. The caps form parallel, spaced-apart, stepped, helical coverings of the rotor periphery, and the thus-formed free spaces that are successively disposed in the circumferential direction between each two axially adjacent caps form stepped, helical hammer lanes.

4 Claims, 10 Drawing Sheets

FIG.1
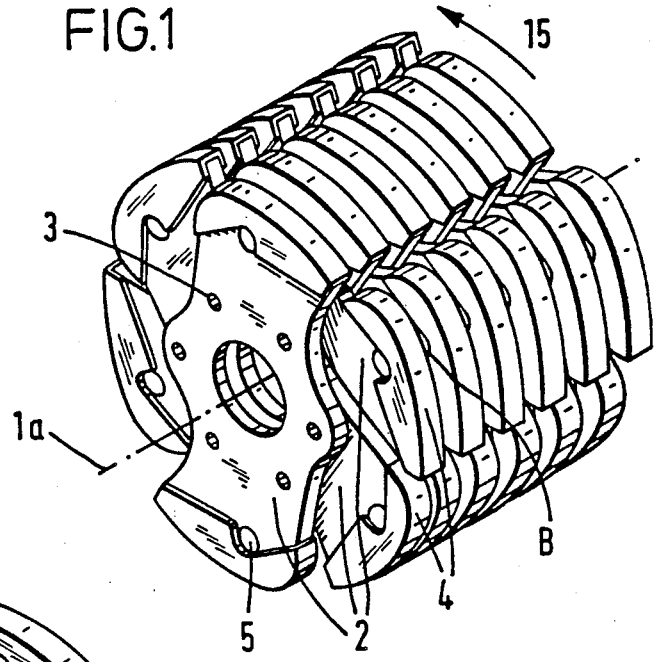
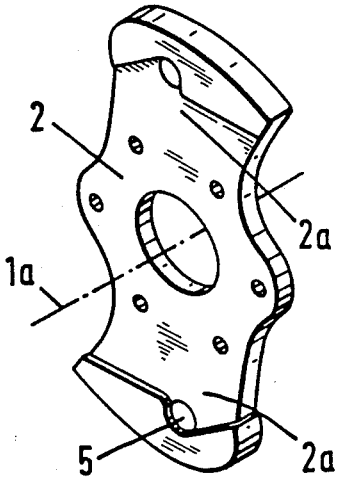
FIG. 2

ROTOR FOR A HAMMER MILL

BACKGROUND OF THE INVENTION

The present invention relates to a rotor for a hammer mill or crusher, for example for breaking-up, shredding, or otherwise reducing the size of scrap, household and industrial refuse, etc.

The material, such as scrap or refuse, that is to be broken up with a hammer mill can have practically any geometric shape and composition. For example, the material can include previously compressed automobile bodies, refrigerators, washing machines, stoves, metal containers, sheet metal items, sheet metal strips, etc. As great a throughput as possible is attempted to be achieved by a suitable arrangement of the arms, and hence of the hammers, in the rotor.

It is known to assemble the rotors for hammer mills for breaking-up scrap or other material of two-part or multi-part arms that are disposed next to one another. If double-ended arms are used, they are staggered by 90° (U.S. Pat. No. 3,844,494) Hightower dated Oct. 29, 1974, while multi-part arms have stars with three or six arm ends that are disposed in a single plane and are distributed uniformly over the periphery of the rotor.

The drawback with the heretofore known shapes and arrangements of the rotor arms is that the ends of the arms generally have only a small crosssectional area, so that the rotor therefore has only a relatively small moment of inertia. In addition, disposed between these arms are large spaces in which scrap or other material can accumulate. Due to the low moment of inertia, and the material that accumulates, the rotor becomes out-of-balance and operates noisily, the speed falls off, and the rotor can also become jammed and can be prevented from operating.

It is therefore an object of the present invention to embody a rotor of the aforementioned general type in such a way that at prescribed dimensions for the rotor, as great a moment of inertia as possible is achieved, the danger of having material accumulate in the spaces between the support elements is greatly reduced, and a good adaptability to the material that is being brokenup at any given time is provided.

BRIEF DESCRIPTION OF THE DRAWINGS

This object, and other objects and advantages of the present invention, will appear more clearly from the following specification in conjunction with the accompanying schematic drawings, in which:

FIG. 1 is a perspective view of a portion of one exemplary embodiment of the inventive rotor with six hammer shafts that are staggered by 60° about the periphery, and support elements that have two oppositely disposed and radially outwardly extending ends;

FIG. 2 is a detailed perspective view of a single support element with caps from FIG. 1;

SUMMARY OF THE INVENTION

Figure 3:
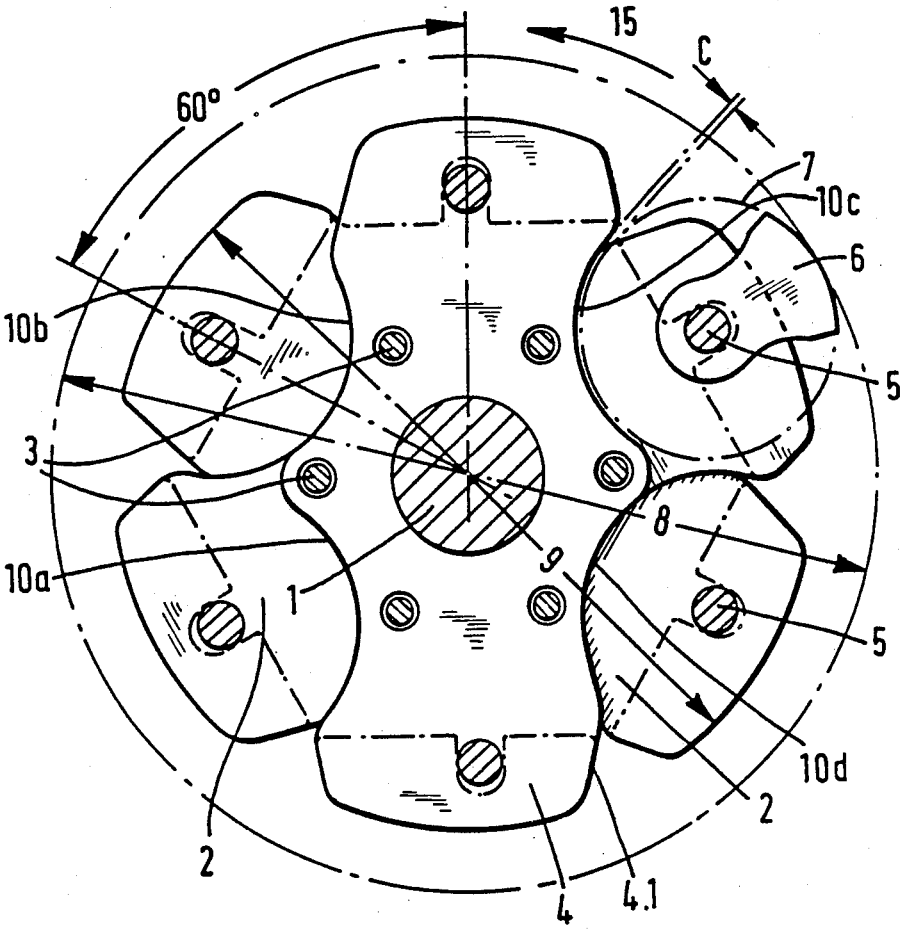
FIG. 3 is an end view through the rotor of FIG. 1.

The rotor of the present invention comprises: a plurality of plate-like support elements that rest against one another in such a way that they are staggered relative to one another in a circumferential direction and are wedged in place against one another in an axial direction, with each support element being secured relative to the axis of rotation of the rotor, and having at least one radially outwardly disposed end, with each end having side faces and with the ends of support elements that are successively arranged in the direction of the axis of rotation being staggered in the circumferential direction while maintaining a uniform spacing from one another; a respective cap for each radially outwardly disposed end of the support elements, with the caps extending over the side faces of its end; hammer shafts that are mounted in the support element ends, extend parallel to the axis of rotation of the rotor, and extend over the entire length of the rotor; and pivotable hammers, or protective members, that are selectively disposed on the hammer shafts, with a given one of the hammers or protective members being disposed between two axially adjacent support element ends that extend parallel to one another, with the hammers being mounted in such a way on the hammer shafts that they are pivotable all the way around; both the caps that immediately follow one another in the circumferential direction, as well as the hammers that immediately follow one another in the circumferential direction, are staggered in the direction of the axis of rotation of the rotor, whereby the caps form parallel, spaced-apart, stepped, helical coverings of the periphery of the rotor, and the thus-formed free spaces that are successively disposed in the circumferential direction between each two axially adjacent caps form stepped, helical hammer lanes.

The present invention provides a rotor that, at prescribed rotor dimensions, has a large moment of inertia, with the caps of the support elements efficiently assisting in the breaking-up and deformation without there being a danger that large agglomerations of material can penetrate into the interior of the rotor in the region between the plate-like support elements. The inventive rotor has a high breaking-up and deforming effect that is adapted to the material that is to be broken-up at any given time. This is achieved by staggering not only the hammers that immediately follow one another in the circumferential direction, but also the caps that immediately follow one another in the circumferential direction, relative to one another in the direction of the axis of rotation of the rotor, with the effective range overlapping both the hammers and the caps. The configuration of the hammer lanes between the coverings of the periphery of the rotor, which coverings are formed by the caps, are stepped, and are helical, results in a conveying tendency, in the axial direction, of the material disposed in the hammer mill. This improves not only the breaking-up and deformation effect of the rotor, but also makes it possible to have an efficient effect upon the flow of material within the hammer mill.

Pursuant to one specific embodiment of the present invention, each support element is provided with only a single radially outwardly extending end for the mounting of a hammer shaft and for receiving a cap. This results in the advantage that with such a rotor, independent of the angle between the support elements that are staggered relative to one another in the circumferential direction, in each case only a single hammer becomes active per revolution of the rotor, so that the impact energy of each hammer is totally utilized.

Pursuant to an alternative embodiment of the present invention, each support element has two oppositely disposed and radially outwardly extending ends for respectively mounting a hammer shaft and for receiving a respective cap, with the support elements that immediately follow one another in the axial direction being respectively staggered relative to one another by the same angle, which is other than 90°.

With this inventive configuration, it is possible, at given rotor dimensions, independent of the angle of stagger between adjacent support elements, to vary the number of spaces that are equipped with hammers, and the number of caps that actively take part in the breaking-up and deformation work, in order to adapt to the material that is being broken-up at any given time.

With both alternative embodiments, the spaces for hammers can, rather than being equipped with hammers, be equipped with shaft-protecting members that on the one hand cover and protect the hammer shaft and the interior of the rotor, and on the other hand if appropriately designed take part in the deformation work.

Pursuant to a further proposal of the present invention, the rotor can comprise rotor sections that have oppositely directed hammer lanes. In this way, it is possible to selectively affect the transverse conveying tendency of the material located in the hammer mill, especially for the design for the removal of material, or to reduce wear at the end walls of the housing.

Further specific features of the present invention will be described in detail subsequently.

DESCRIPTION OF PREFERRED EMBODIMENTS

Referring now to the drawings in detail, in the rotor portion illustrated in FIG. 1, a plurality of support elements 2 are connected, via connecting rods 3 that extend parallel to the axis of rotation 1*a* of the rotor, to form a rotor member. Each of the support elements 2 has two oppositely disposed ends 2*a* (see FIG. 2) that extend radially outwardly and in which are mounted the hammer shafts 5, which are not illustrated in detail. Secured to the ends 2*a* of the support elements 2 are caps 4, the side walls of which overlap or extend over the side faces of the ends 2*a*. In the embodiment illustrated in FIG. 1, the support elements 2 are rotationally staggered relative to one another in such a way that they maintain a uniform spacing of 60° from one another.

Thus, the caps 4 provide a stepped and helical covering for the periphery of the rotor.

In the region of the hammer shafts 5, between each two ends 2*a* that are parallel to one another in the axial direction, and between the caps 4, there results a space B for a hammer. A respective pivotable hammer, or a member for protecting the hammer shaft, can be disposed in the space B.

The detailed view of FIG. 2 illustrates one of the support elements 2 of FIG. 1 in perspective. FIG. 3 is an end view of the rotor of FIG. 1. Each hammer 6 has an all-the-way-around pivot path that is indicated by the reference numeral 7. The diameter of the path generated by the hammers 6 during rotation of the rotor is indicated by the reference numeral 8, and the diameter of the rotor, as measured to the outer periphery of the caps 4, is indicated by the reference numeral 9. The longitudinal sides of the double-ended support elements 2 are provided with a total of four arclike recesses 10*a*, 10*b*, 10*c*, 10*d*, which, except for a small space C, extend nearly to the pivot path 7 of the hammers 6 that is possible depending upon the type of installation in the rotor.

Figure 4:
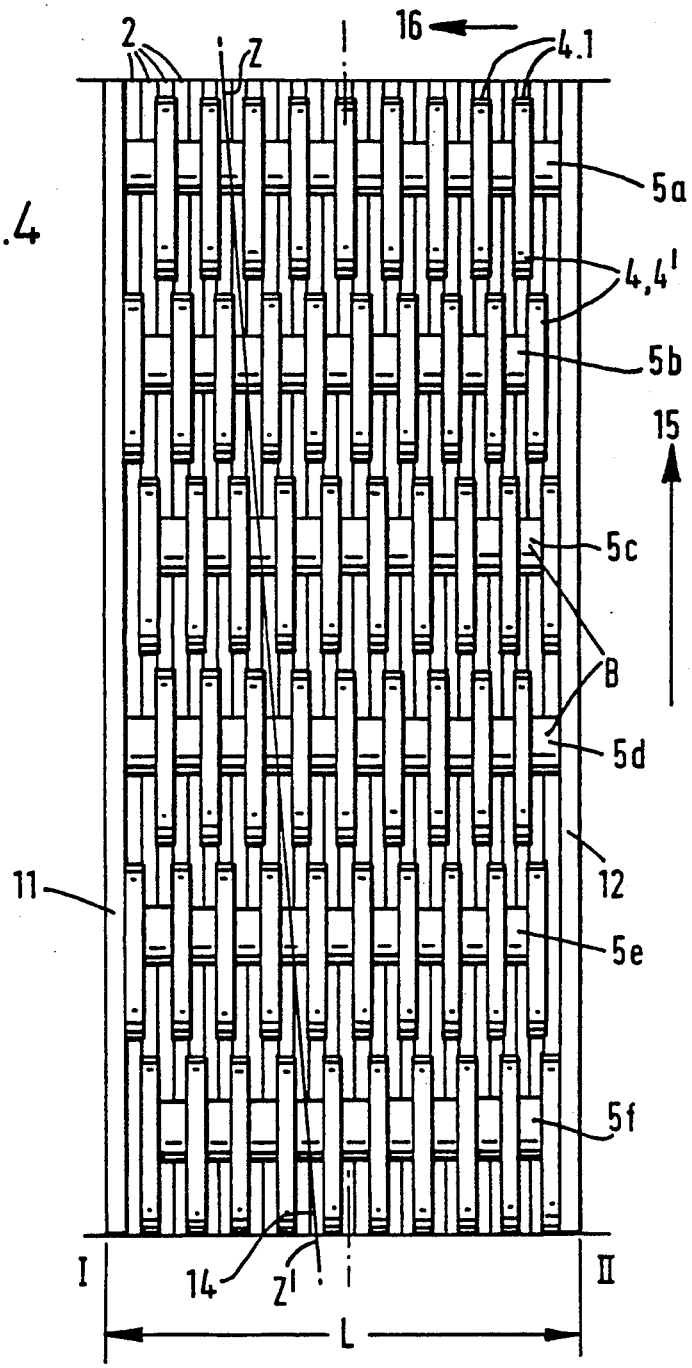
FIG. 4 is a view that shows a projection into a plane of the surface of a rotor having six hammer shafts that are staggered by 60° about the periphery support elements with two oppositely disposed and radially outwardly extending ends with caps, and helically extending hammer lanes.

In the projection into a plane of the rotor surface illustrated in FIG. 4, twenty-nine doubledended support elements 2 are disposed, in this exemplary embodiment, along the rotary length L between the end plates 11 and 12. Six hammer shafts are present, and are indicated by the reference symbols 5*a*, 5*b*, 5*c*, 5*d*, 5*e*, and 5*f*. The regions overlapped by the caps 4 are indicated by the reference numeral 4'. The number of possible spaces B for a hammer respectively disposed between two adjacent support element ends or between the support element ends and the end plates 11 and 12 is fifty-six, with a maximum of two spaces B for hammers being available for a given support element plane. The hammer lanes 14 extend over the periphery of the rotor, as seen from Z to Z', between the caps 4, which are disposed one after the other in a laterally offset manner in the circumferential direction. With the direction of rotation of the rotor indicated by the arrow 15 in FIG. 4, and a lining-up in the direction of the arrow 16 of double-ended support elements 2 that are rotationally staggered by 60° in a clockwise direction, a helical arrangement of the caps 4 results on the rotor periphery. Due to the deflection and deforming of the broken-up material at the front sides 4.1 of the support elements in the direction toward the respective hammer lane 14, the aforementioned helical arrangement of the caps 4 leads to a conveying tendency counter to the direction of the arrow 16. Removal of dirt and small particles can then be provided for at the rotor end II. Thus, no removal is needed at the rotor end I.

Figure 5:
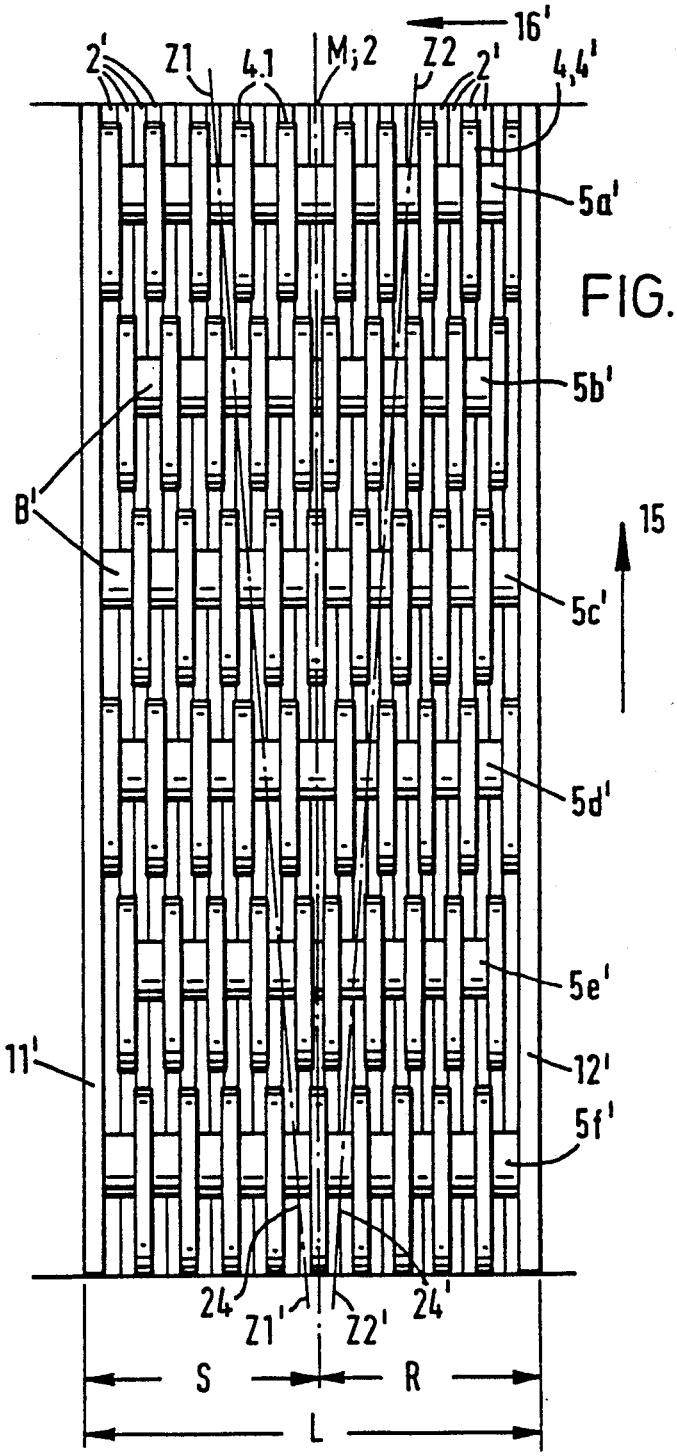
FIG. 5 is a view that shows the projection into a plane of the surface of a rotor, similar to FIG. 4, but with oppositely directed hammer lanes.

In the projection into a plane of the rotor surface illustrated in FIG. 5, twenty-nine doubleended support elements 2' are disposed in this exemplary embodiment along the length L of the rotor between the end plates 11' and 12'. The six hammer shafts that are present are indicated by the reference symbols 5*a*', 5*b*', 5*c*', 5*d*', 5*e*', and 5f'. The regions overlapped by the caps 4 are indicated by the reference numeral 4'. The hammer lanes 24 extend over the periphery of the rotor from Z1 to Z1', and the hammer lanes 24' from Z2 to Z2', between the caps 4, which are disposed one after the other in a laterally offset manner in the circumferential direction. The hammer lanes 24 and 24' have different helical directions, and extend symmetrical to the support element plane M. The directions of the parallel hammer lanes 24 and 24' in the length sections S and R respectively of the rotor result from the following: in the direction of rotation of the rotor indicated by the arrow 15' in FIG. 5, and a lining-up in the direction of the arrow 16' and up to the support element plane M of double-ended support elements 2' that are staggered by 60° in a counterclockwise direction, there is provided on the rotor periphery a helical arrangement of the caps 4 that extends in the direction Z2—Z2'; in the lining-up that extends from the support element plane M to the end plate 11' of double-ended support elements 2' that are staggered by 60° in the clockwise direction, there results on the rotor periphery a helical arrangement of the caps 4 that extends in the direction of Z1—Z1'. With this oppositely directed arrangement of the support elements 2', the broken-up material is deflected toward the center of the rotor. The number of possible spaces B' for a hammer respectively disposed between two adjacent support element ends or between support element ends and the end plates 11' and 12' is fifty-four in the embodiment of FIG. 5.

Figure 6:
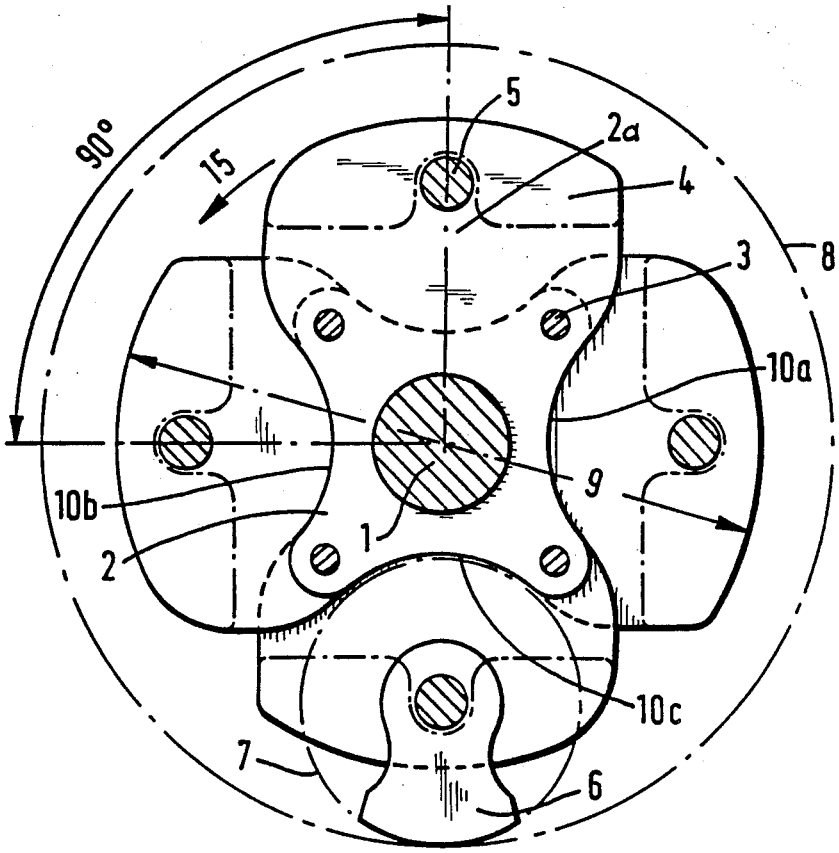
FIG. 6 is an end view through a rotor with four hammer shafts that are staggered by 90° about the periphery, and support elements that have only a single radially outwardly extending end with a cap.

The end view of a further exemplary embodiment of a rotor illustrated in FIG. 6 shows a plurality of support elements 2, each of which has only a single end 2a that extends radially outwardly. Disposed on the outside of each end 2a is a cap 4, with the support elements 2 and caps 4 being respectively rotationally staggered by 90° on the rotor shaft 1. The support elements 2 are secured in place relative to one another in the axial direction by four connecting rods 3. The hammers 6 are pivotably disposed on the hammer shafts 5, which extend over the length of the rotor and are mounted in the ends 2a of the support elements 2; the pivot path is again designated by the reference numeral 7. The protective caps 4 overlap or extend over the side faces of the support element ends 2a.

Figure 7:
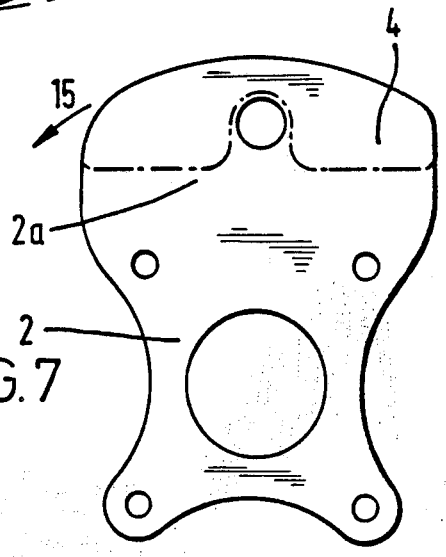
FIG. 7 is a side view of a support element with a cap for the rotor of FIG. 6.

FIG. 7 is a detailed view of a support element 2 having only a single radially outwardly extending end 2a, on the outside of which is secured a cap 4.

Figure 8:
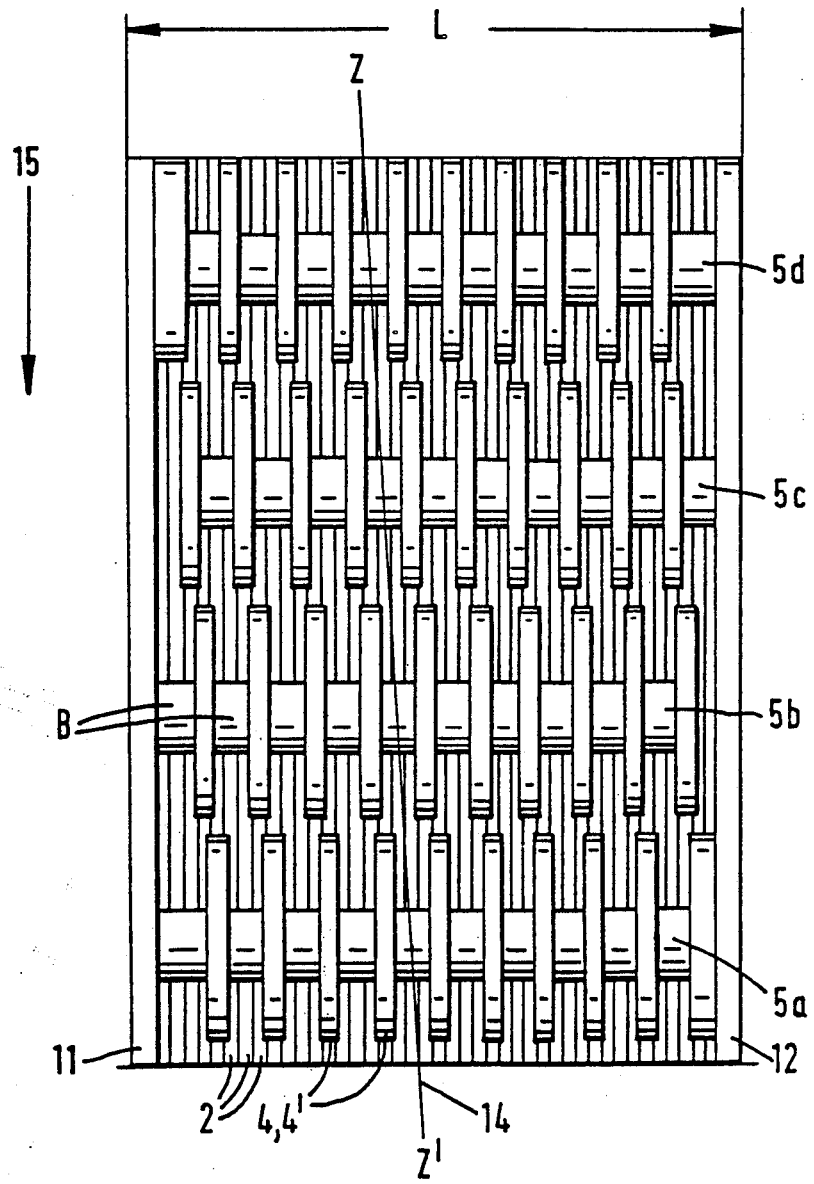
FIG. 8 is the projection into a plane of the surface of a rotor of FIG. 6 with four hammer shafts that are staggered by 90° about the periphery, with support elements having only a single radially outwardly extending end with a cap, and with helically extending hammer lanes.

In the projection into a plane of the rotor surface illustrated in FIG. 8, forty support elements 2 that have only a single radially outwardly extending end and caps 4 secured on the outside are arranged in this exemplary embodiment along the rotor length L between the end plates 11 and 12. The four hammer shafts that are present are indicated by the reference symbols 5a, 5b, 5c, and 5d. The regions of the rotor surface overlapped by the caps 4 are indicated by the reference numeral 4'. The number of spaces B for hammers that are possible is forty. A helical hammer lane 14 extends over the periphery of the rotor, as seen from Z to Z', between the caps 4 that are disposed one after the other, in a laterally offset manner, in the circumferential direction.

Figure 9:
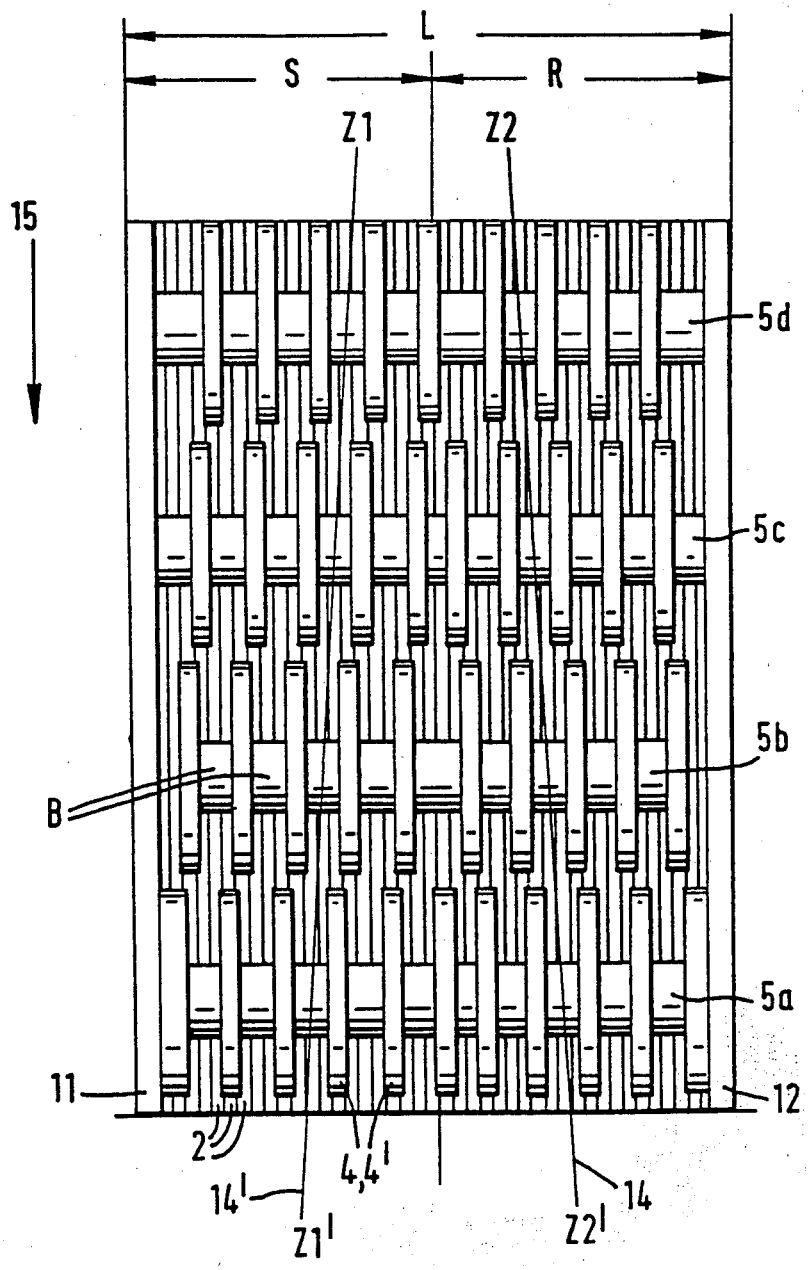
FIG. 9 is a view that shows the projection into a plane of the surface of a rotor, similar to FIG. 8, but with oppositely directed hammer lanes.

In the projection into a plane of the rotor surface illustrated in FIG. 9, forty support elements 2 having a total of thirty-nine spaces for hammers are disposed in this exemplary embodiment over the rotor length L between the end plates 11 and 12. By disposing the support elements 2 in opposite directions in the rotor portions S and R, there results in this embodiment, in a manner similar to that of the embodiment of FIG. 5, oppositely directed, helical hammer lanes 14 and 14' between Z1—Z1' and Z2—Z2'. As a result, the conveying tendency for the broken-up material is also oppositely directed.

Figure 10:
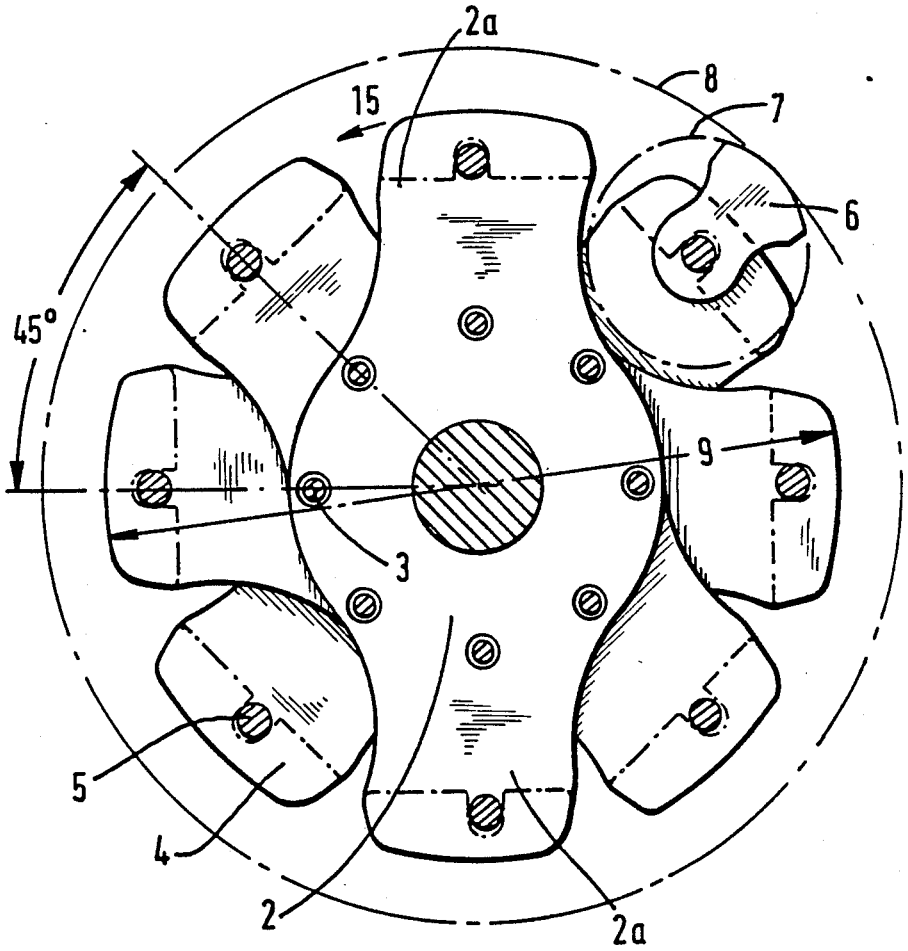
FIG. 10 is a cross-sectional end view through a rotor having eight hammer shafts staggered by 45° about the periphery, and support elements having two oppositely disposed and radially outwardly extending ends with caps.

In the end view of a rotor shown in FIG. 10, support elements 2 are disposed on the periphery of the rotor in such a way that they are rotationally staggered by 45°. The support elements 2 each have oppositely disposed, radially outwardly extending ends 2a, on the outer ends of which are placed caps 4.

Figure 11:
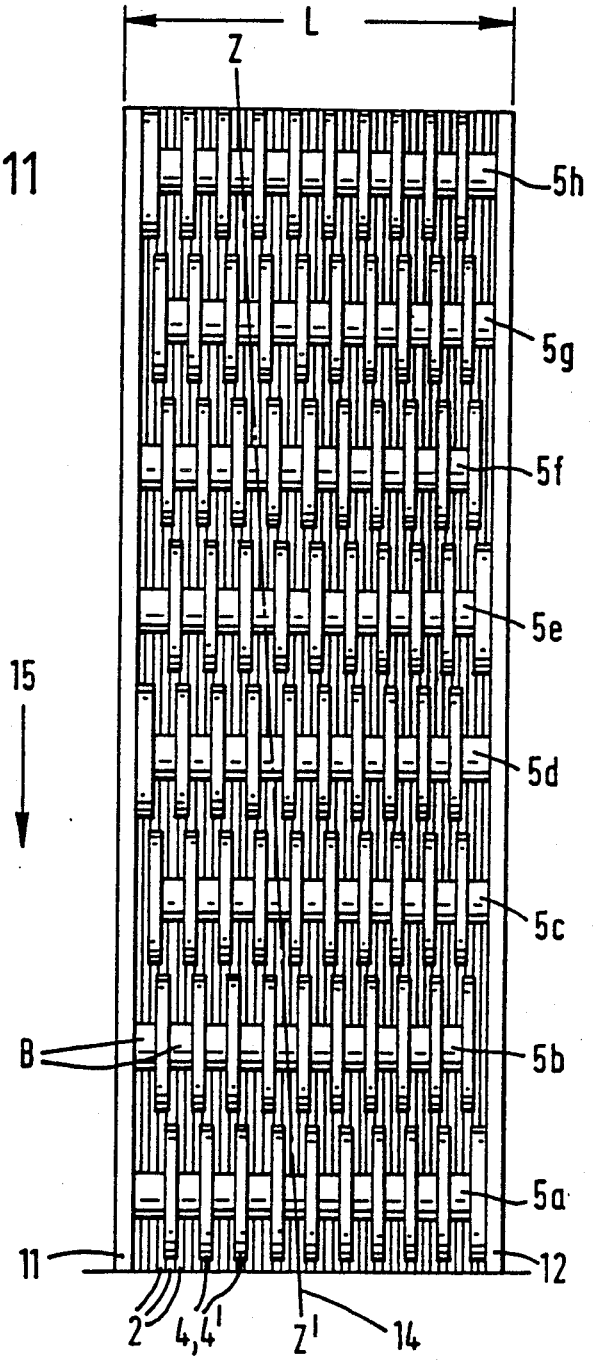
FIG. 11 is a view that shows the projection into a plane of the surface of a rotor of FIG. 10 with helically extending hammer lanes.

FIG. 11 shows the projection into a plane of the surface of the rotor of FIG. 10. The eight hammer shafts, which are respectively staggered by 45°, are indicated by the reference symbols 5a to 5h. In this embodiment, forty support elements, each having two oppositely disposed ends, are disposed along the rotor length L between the end plates 11 and 12. This results in a total of eighty spaces B for hammers. As with the previously described embodiments, this arrangement also results in helical hammer lanes 14.

Figure 12:
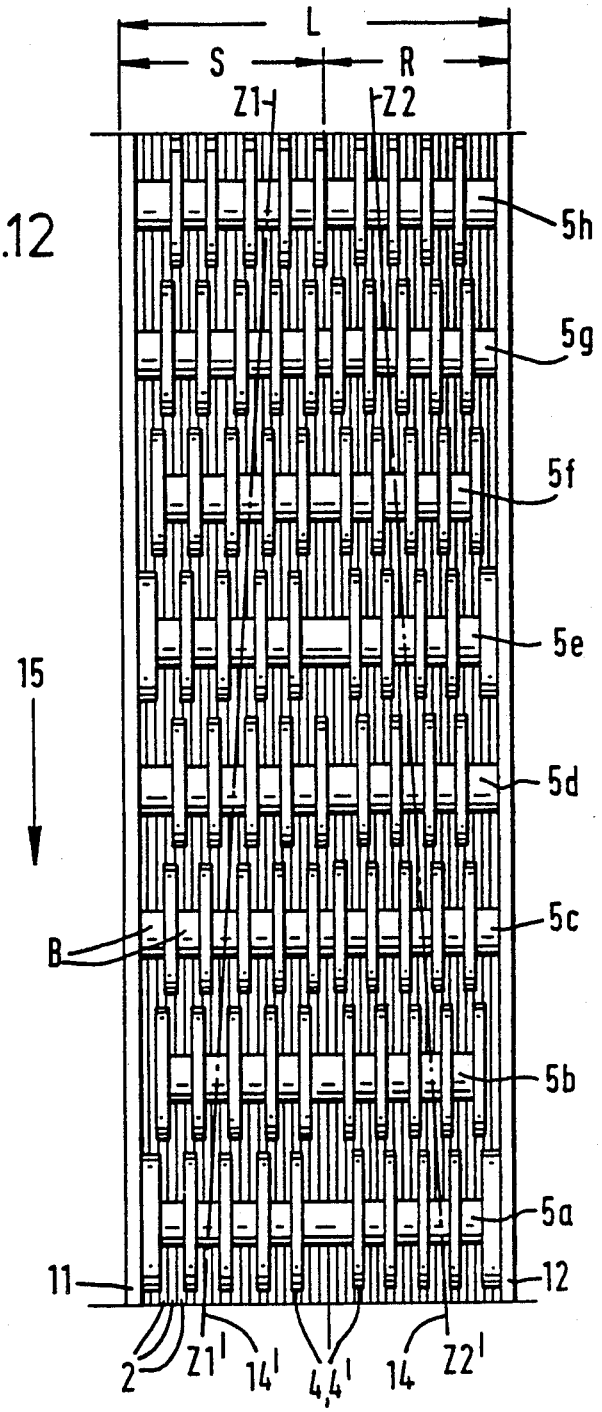
FIG. 12 is a view that shows the projection into a plane of the surface of a rotor, similar to FIG. 10, yet with oppositely directed helical hammer lanes.

FIG. 12 also shows the surface of a rotor of FIG. 10, but with oppositely directed, helical hammer lanes 14 and 14' in a manner similar to that of some of the previous embodiments. In the embodiment of FIG. 12, of forty support elements, each having two oppositely disposed ends, are disposed along the rotor length L between the end plates 11 and 12. This results in a total of seventy-six spaces B for hammers.

With all of the aforementioned embodiments, the available spaces B for hammers can be equipped with various numbers of hammers 6 depending upon the type of material that is to be broken up. Spaces B for hammers that are not equipped with hammers contain protective members to protect the hammer shafts.

The present invention is, of course, in no way restricted to the specific disclosure of the specification and drawings, but also encompasses any modifications within the scope of the appended claims.

What I claim is:

1. A rotor for a hammer mill for breaking-up, shredding as well as otherwise reducing the size of scrap, household and industrial refuse, said rotor having an axis of rotation extending over the entire rotor length and comprising:

a plurality of plate-shaped support elements that rest against one another in such a way that they are staggered relative to one another in a circumferential direction and the support elements are wedged in place against one another in an axial direction; each support element is secured relative to said axis of rotation and has at least one radially outwardly disposed end, with each such end having side faces, and with said ends of support elements that are successively arranged in the direction of said axis of rotation of said rotor being staggered as to other ends of support elements in the circumferential direction while maintaining a uniform parallel spacing of the ends per se from one another for the radially outwardly disposed ends relative to each other which, due to being staggered, are not located directly against each other and the spacing between parallel ends in the axial direction of the hammer axis amounts to at least a thickness of two support elements so that all support elements per se are clamped against each other and all scrap, household and industrial refuse is accessible without any thereof being missed;

a respective cap for each radially outwardly disposed end of said support elements, with said caps also extending over said side faces of its respective support element end;

hammer shafts that are mounted in said support element ends, extend parallel to said axis of rotation of said rotor, and extend over the entire axial length of said rotor; and pivotable hammers that are selectively disposed on said hammer shafts, with a given one of said hammers being disposed between two axially adjacent support element ends that extend parallel to one another, with said hammers being disposed on said hammer shafts in such a way as to be pivotable entirely all the way around a pivot axis thereof; both the caps that immediately follow one another in the circumferential direction, as well as the hammers that immediately follow one another in the circumferential direction, are staggered in the direction of the axis of rotation of said rotor, whereby said caps form parallel, spaced-apart, stepped, helical coverings of the periphery of said rotor, and the thus-formed free spaces that are successively disposed in the circumferential direction between each two axially adjacent caps form stepped, helical hammer lanes permitting full access of said pivotable hammers everywhere as to all scrap, household and industrial refuse without any omission of access thereto.

2. A rotor according to claim 1, in which each of said support elements has only a single radially outwardly extending end for the mounting of a hammer shaft and for receiving a cap.

3. A rotor according to claim 1, in which each of said support elements has two oppositely disposed, radially outwardly extending ends, each of which serves for the mounting of a hammer shaft and for receiving a cap; and in which said support elements that immediately follow one another in the axial direction are each staggered from one another by the same angle, which is other than 90°.

4. A rotor according to claim 1, which is composed of portions having hammer lanes that extend in opposite directions.

* * * * *